US005152203A

United States Patent [19]

Wierschke

[11] Patent Number: 5,152,203

[45] Date of Patent: Oct. 6, 1992

[54] APPARATUS AND METHOD FOR SHARPENING SAW BLADES HAVING PLANETARY MOTION IN TRANSVERSE CUTTING

[75] Inventor: Larry Wierschke, Green Bay, Wis.

[73] Assignee: Paper Converting Machine Company, Green Bay, Wis.

[21] Appl. No.: 746,937

[22] Filed: Aug. 19, 1991

[51] Int. Cl.[5] ..... B26D 7/12

[52] U.S. Cl. ..... 83/13; 83/174; 83/329; 51/248; 51/288

[58] Field of Search ..... 83/13, 14, 174, 174.1, 83/329; 51/247, 248, 288; 76/82, 85, 86

[56] References Cited

U.S. PATENT DOCUMENTS

| | | | |
|---|---|---|---|
| Re. 30,598 | 5/1981 | Spencer | 83/174 X |
| 2,052,367 | 8/1936 | Folk | 51/248 |
| 3,233,488 | 2/1966 | Deichmann | 83/174 |
| 4,041,813 | 8/1977 | Spencer | 83/14 |
| 4,347,771 | 9/1982 | Bradley | 83/174 |
| 4,584,917 | 4/1986 | Blom | 83/174 |
| 4,821,613 | 4/1989 | Hertel | 83/13 |

*Primary Examiner*—Frank T. Yost
*Assistant Examiner*—Raymond D. Woods
*Attorney, Agent, or Firm*—Tilton, Fallon, Lungmus & Chestnut

[57] ABSTRACT

A method and apparatus for sharpening saw blades having planetary motion in transverse cutting as for multi-ply webs in stacks or log rolls wherein a saw blade is carried on a planetary arm moving through an orbit skewed relative to the path of travel of the product to be cut, the grinding system being mounted on the planetary arm and including an adjustment arm carrying grinding stones; the adjustment arm being pivoted to bring the stones in contact with the blade and indexed so as to compensate for blade wear.

7 Claims, 4 Drawing Sheets

Fig. 1
PRIOR ART
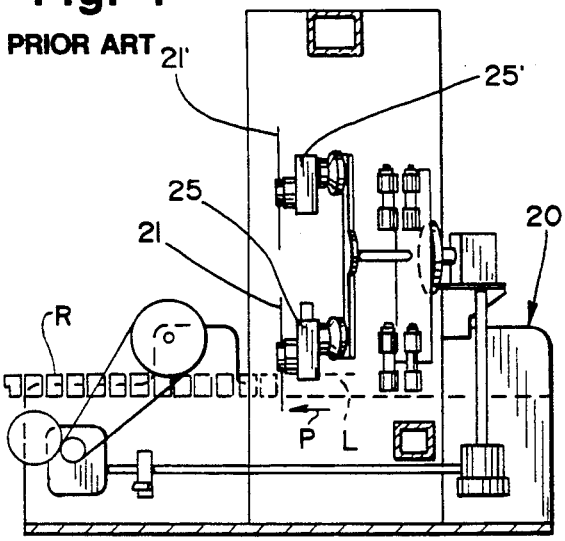
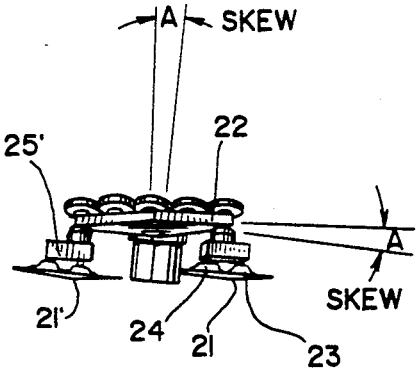
Fig. 2
PRIOR ART
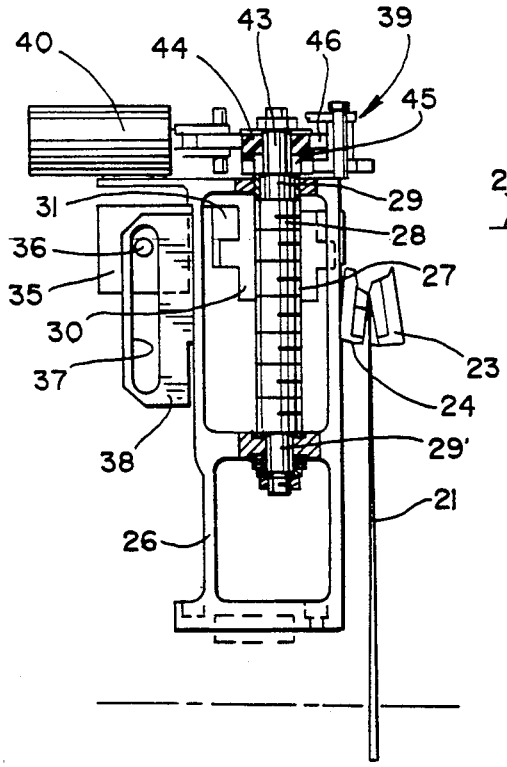
Fig. 3
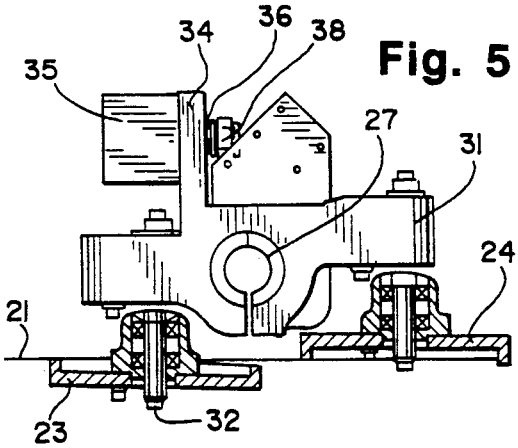
Fig. 5
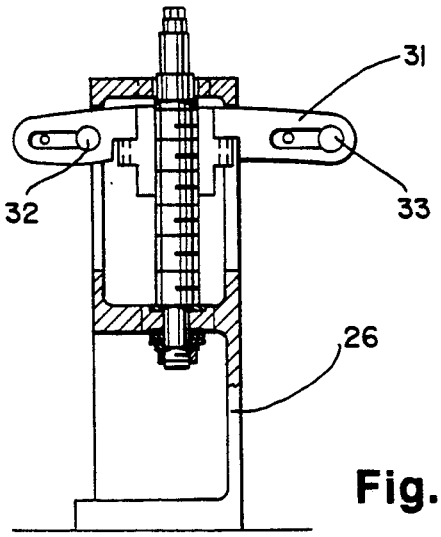
Fig. 4

Fig. 9
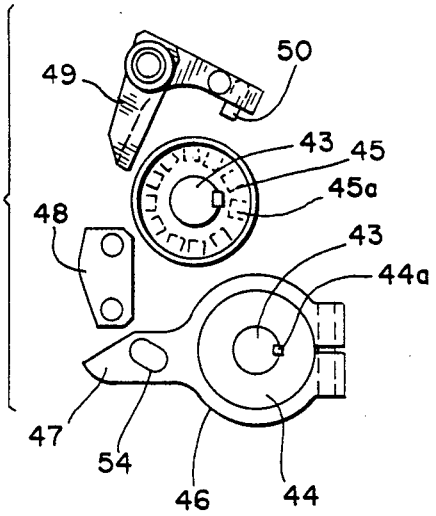
Fig. 8
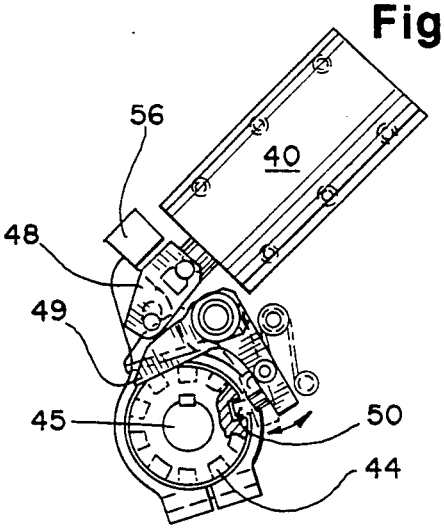
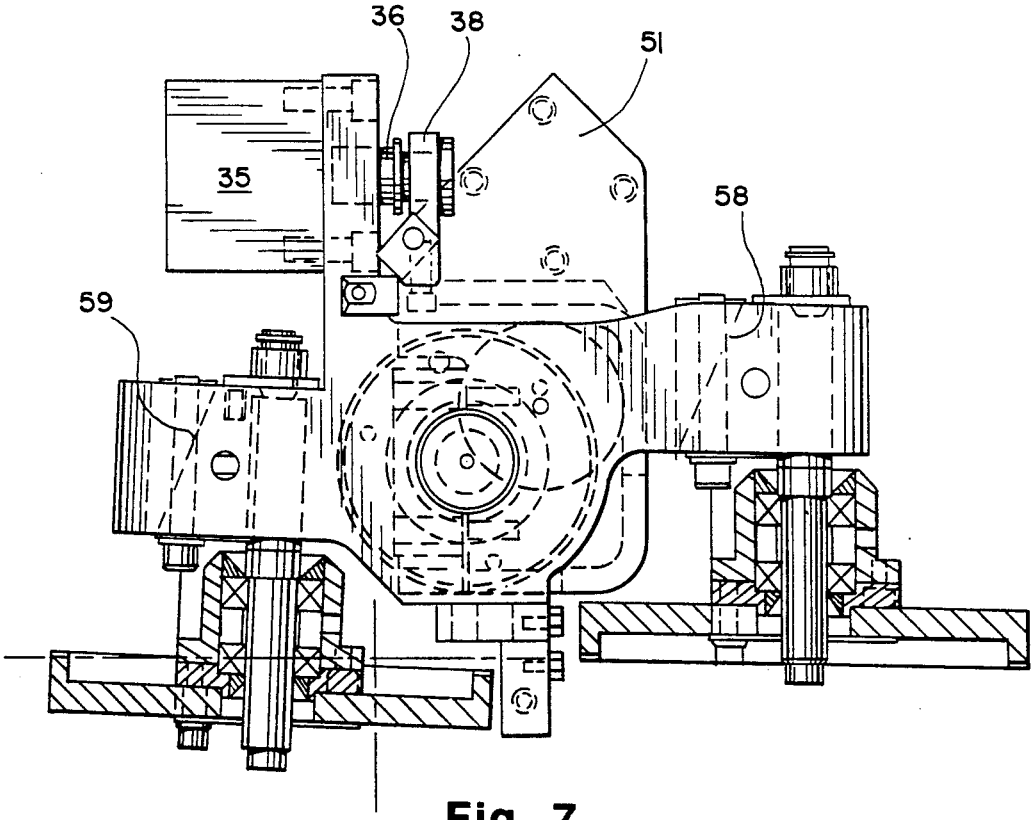
Fig. 7

Fig. 10
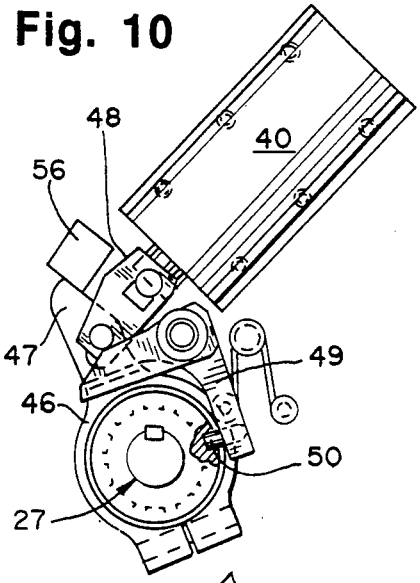
Fig.11
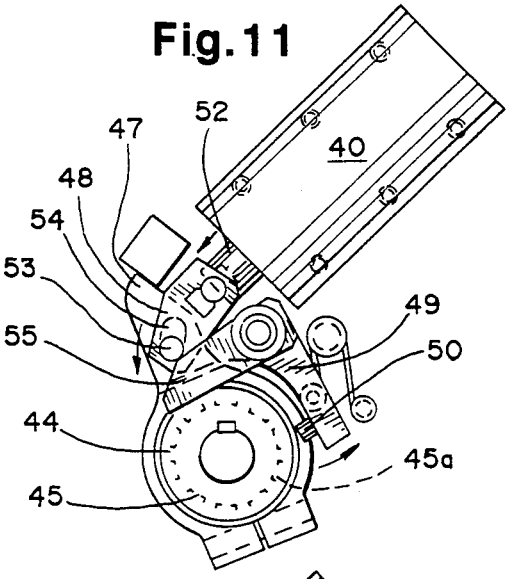
Fig.12
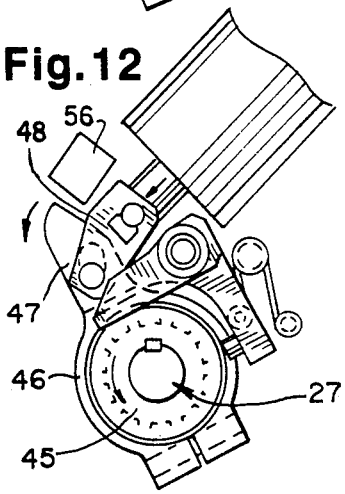
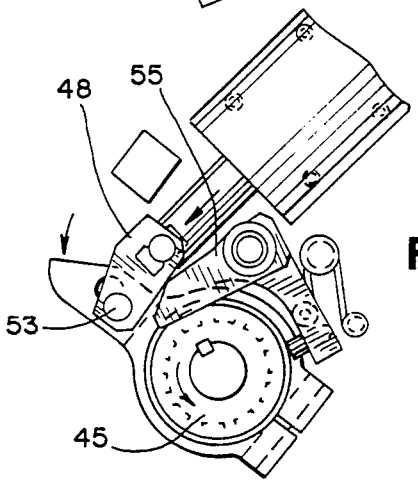
Fig.13
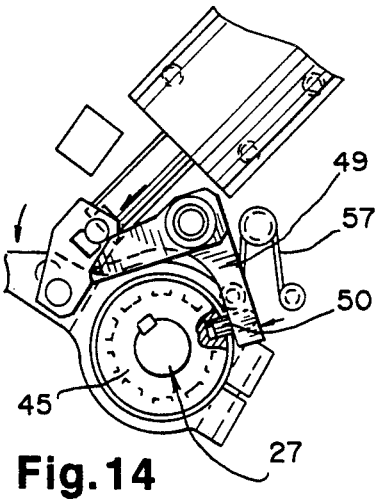
Fig.14
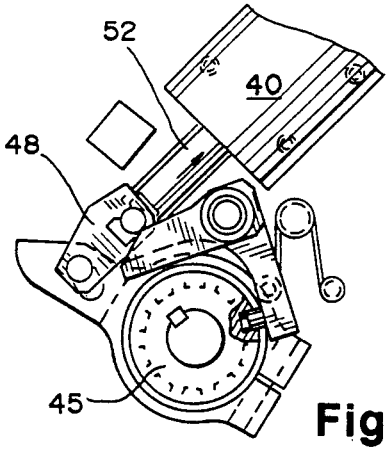
Fig.15

APPARATUS AND METHOD FOR SHARPENING SAW BLADES HAVING PLANETARY MOTION IN TRANSVERSE CUTTING

BACKGROUND AND SUMMARY OF INVENTION

This invention relates to apparatus and method for sharpening saw blades having planetary motion in transverse cutting and, more particularly, to apparatus and method for transversely cutting continuously moving multi-ply web material such as convolutely wound paper logs, superposed plies, etc. The basic teaching to which this invention applies is co-owned U.S. Pat. No. 4,041,813 and reference may be had thereto for details of construction and operation not set forth herein.

The above-mentioned patent has to do with a continuous motion "CM" saw, viz., the product being cut is moved continuously in contrast to being indexed or stepped. This involved moving a disc blade through a planetary orbit, i.e., one skewed to the transverse cutting plane. During cutting, this advanced the saw along the path of travel of the material being cut, i.e., the convolutely wound log or the like. It will be appreciated that in making toilet tissue or toweling, retail diameter logs are rewound at high speed from a parent roll and then transversely cut to retail length rolls.

Although the "CM" saw of the '813 patent has been commercially available there have been difficulties in sharpening its blades so that the industry has been using intermittent motion saws such as that described in co-owned U.S. Pat. Nos. 4,584,917 and 4,821,613. Such a saw, running at full speed has a constant centrifugal loading of 8.3 g's at a constant direction relative to the grinder. Due to the simple rotary motion of the grinder assembly and the ability to bolt the grinder to a primary rotating machine member, component mass, compactness and resistance to cyclic loading are of little concern during grinder design.

However, a "CM" saw at full speed has a constant centrifugal loading at of 27.3 g's (4 times greater) but a worse problem is that due to the planetary motion the direction of the force is constantly changing relative to the grinder assembly. The force direction inside the grinder moves through 360° during each cycle of product cutting. Each component of the assembly is therefore under fatigue loading being cycled ¼ million times each day. This is why since the invention of the "CM" saw a grinder has not been found that will reliably hold up and give a high quality grind or hone at the speeds customers demand. Because of the skew angle the unit can only be mounted to the blade spindle housing. This is the only machine member that follows the blades path. This housing is relatively small and should be kept in balance, yet forces the grinders to be cantilever mounted which again is difficult due to the cyclic loading and balancing problems.

Past designs relied on independently bringing in each grinding stone to a set position using a linear (or near linear) motion. My design instead takes both stones and mounts them on a common arm and then using a pivoting motion causes both stones to simultaneously contact the blade and stop at a set position with a single moving part.

The main advantage is a single moving part, since each part that moves is subject to a certain amount of looseness. It's that looseness that gives the cyclic loading a foot hold for causing wear and failure of parts. To then fight wear at the pivot point, the cylinder that causes the pivoting action has enough force capacity to push out all looseness in the pivot joint while operating at up to 45 g's (250 rpm).

Another advantage is less weight because there is now only one moving part to grind in contrast to the prior duplicate independent assemblies. Also the use of less parts reduces the cost.

Still another advantage is the ease of stone adjustment to compensate for blade wear. Normally, a 24" diameter blade will wear down to 18" during its cutting life. This requires the grinding stones to move closer to the blade axis to maintain contact with the blade periphery.

To achieve grinding under these circumstances, the pivoting motion of the stones was applied to a nut and screw. The screw can then be turned to give manual adjustment or with the addition of an indexing system it can be done automatically. The locking system for the screw is necessary for both the manual or automatic arrangements again due to the cyclic loads which may try to turn the screw. Since the screw must turn to give adjustment it is also subject to looseness, but the same cylinder that removes the looseness in the pivoting arm will also remove this radial clearance. The screw is heavily preloaded in the axial direction to also remove that looseness, and the auto adjustment and locking areas include springs that remove looseness from its joints.

BRIEF DESCRIPTION OF THE DRAWINGS

The invention is described in conjunction with an illustrative embodiment in the accompanying drawings, in which—

FIG. 1 is a schematic side elevational view of a transverse cutting apparatus constructed according to the teachings of the prior art, namely U.S. Pat. No. 4,041,813, and is presented here to illustrate the environment;

FIG. 2 is a fragmentary top perspective view of a portion of the apparatus of FIG. 1 and also is derived from U.S. Pat. No. 4,041,813;

FIG. 3 is a fragmentary side elevational view of a fragment of sharpening apparatus constructed according to the teachings of this invention;

FIG. 4 is another side elevational view of the inventive apparatus taken at right angles to the showing in FIG. 3;

FIG. 5 is a top elevational view of the showings in FIGS. 3 and 4;

FIG. 7 is a top elevational view corresponding essentially to FIG. 5 but showing additional details;

FIG. 8 is a top plan view of the height adjustment feature of the invention;

FIG. 9 is an exploded top plan view of the apparatus of FIG. 8;

FIG. 10 is a view similar to FIG. 8 and showing the height adjustment feature in its normal or standby position awaiting a signal for the start of moving the sharpening stones; and FIGS. 11–15 are views similar to FIG. 10 but showing the sequence of operation of the height adjustment feature.

DETAILED DESCRIPTION

Figure 6:
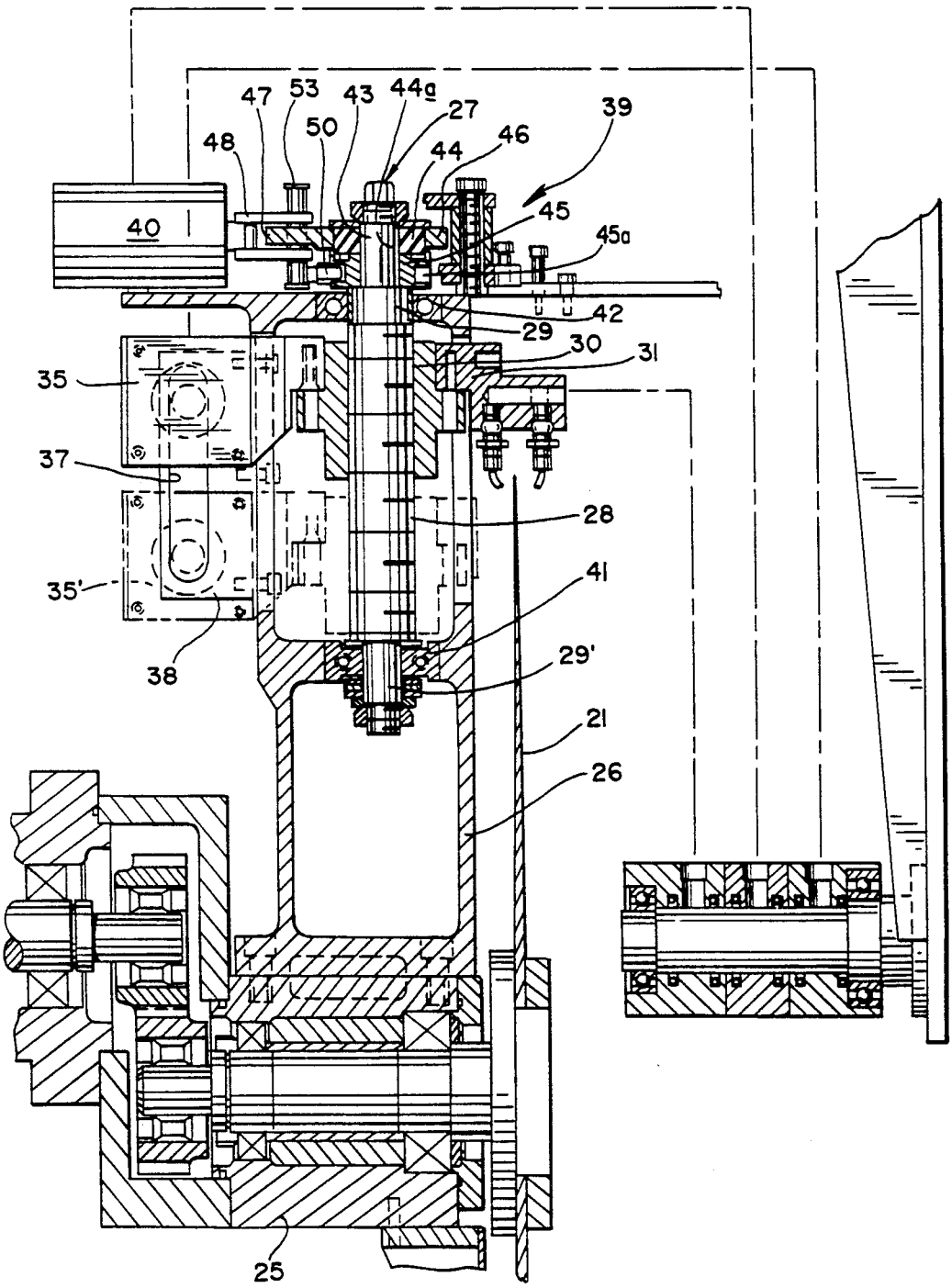
FIG. 6 is an enlarged fragmentary view corresponding essentially to FIG. 3 but showing additional details.

To simplify the description of the invention, reference is made to FIGS. 1 and 2 which are representative of the prior art, notably U.S. Pat. No. 4,041,813. This showing is for a log saw such as is employed in the production of retail size rolls of toilet tissue and toweling. It consists of a frame generally designated 20 through which a log L is advanced along a path P and transversely severed into retail size rolls R. For this purpose, a pair of disc blades 21, 21' are moved in a planetary fashion by virtue of being mounted on a planetary arm 22. The skew angle A is illustrated in FIG. 2 relative to the planetary arm 22 and the showing in FIG. 2 differs from that of FIG. 1 in that the disc blades 21, 21' are horizontally aligned in FIG. 2 as contrasted to being vertically aligned in FIG. 1. Seen also in FIG. 2 are a pair of sharpening stones as at 23 and 24 for the disc blade 21 and inasmuch as this invention is concerned with the structure and operation of the mounting stones, details of the planetary drive and the remainder of the apparatus of FIG. 1 are omitted. For such details, reference should be made to U.S. Pat. No. 4,041,813.

It will be noted that each of the disc blades 21, 21' is equipped with a sub-frame as at 25, 25' and it is on a corresponding sub-frame that the inventive apparatus is mounted — see for example the lower left hand portion of FIG. 6.

Still referring to FIG. 6, it will be seen that a housing 26 is boltably secured to the sub-frame 25 and the housing 26 can also be seen in the lower portions of FIGS. 3 and 4 to which reference now will be made.

The housing 26 rotatably supports a member generally designated 27 which is employed in both the pivot and adjustment functions employed in the practice of the invention.

Pivot Function

To achieve the pivoting motion which causes both stones 23, 24 to simultaneously contact the disc blade 21, I use the member 27 as a pivot post or center. It will be seen that there is a central threaded portion 28 on the member 27 and at each end a cylindrical portion as at 29 and 29' which are journaled in the housing 26. Mounted on the threaded portion 28 of the member 27 is a threaded nut 30 which is part of the adjustment arm 31 — see particularly FIGS. 4 and 5. It is the arm 31 which carries the stones 23, 24 on suitable shafts as at 32 and 33.

Referring particularly to FIG. 5, it is seen that the arm 31 is relatively elongated and centrally pivoted on the member 27. Adjacent the ends of the adjustment arm 31 are the shafts 32, 33 which carry the stones 23, 24. The adjustment arm 31 also has an integral flange 34 on which is mounted a cylinder and piston rod unit 35. The rod 36 extends into a slot 37 (see the left hand portion of FIG. 3) in a bracket 38 fixed to the housing 26. Thus, as the rod 36 is extended or retracted relative to the bracket 38, the arm 31 pivots on the member 27 and brings the stones 23, 24 into and out of sharpening position relative to the disc blade 21.

The slot 37 in the bracket 38 provides for the relocation of the arm 31 as the diameter of the disc blade 21 decreases, viz., the adjustment feature.

Adjustment Feature

Reference to FIG. 6 shows the cylinder and piston rod unit 35 in solid line in its upper position as at the beginning of a blade's life and in dotted lines as at 35' at the end of a blade's life — indicating the need for blade replacement. The movement of the adjustment arm 31 is achieved by an adjusting mechanism generally designated 39. This includes another cylinder 40 which turns the member 27 and thus moves the arm 31 downwardly (as shown).

The member 27, as indicated, has a lower unthreaded portion 29' which is received with a thrust bearing 41 and an upper portion 29 ensleeved by a bearing 42. Above the portion 29, the member 27 has a reduced diameter cylindrical portion 43 to which is keyed an overriding clutch 44. This can be seen clearly in the central portion of FIG. 9 where the clutch 44 is keyed to the portion 43 by means of a key **44*a*. Also keyed at 44*a* to the portion 43 below the clutch 44 is an index cylinder 45 — see the upper central portion of FIG. 6**.

Rotatably mounted on the overriding clutch 44 is a clutch clamp 46. The clutch clamp 46 has a projection 47 which is actuated by the adjustment cylinder 40 for rotating the member 27 and thus moving the adjustment arm 31.

The illustrated means for coupling the cylinder 40 to the projection 47 will now be described.

Coupling Mechanism

Referring now to FIGS. 8 and 9, a swivel link 48 and a locking arm 49 are interposed between the cylinder 40 and the projection 47 of the clutch clamp 46. The locking arm 49 is equipped with a pawl 50 which is adapted to enter into conforming slots within the index cylinder 45.

It is believed that the interrelationship of the elements 47–50 to bring about rotation of the member 27 by the cylinder 40 can be best understood by referring to a series of views showing the sequence of operation. Reference is now made to FIGS. 10–15. FIG. 10 shows the configuration of elements as they would be disposed when the adjustment system is waiting for the start of adjustment, viz., indexing of the screw 28 to move the adjustment arm 31.

The adjustment of the stones 23, 24 is initiated by a programmable controller (not shown) which causes the pivoting adjustment arm 31 to lower a constant amount each time the controller indicates a certain total of grind time at one position is achieved. This value is in the program and will be subject to change depending upon the conditions at the user. By giving the operator control of the grind duration and frequency, the operator can still make day-to-day adjustments but no matter how much they are changed, the controller will continue to sum the accumulated grind time and make adjustments when needed. The signal from the controller is delivered to the air cylinder 40 which is mounted on a flange 51 of the housing 26 — see FIG. 7 in the central portion thereof.

The initial extension of the piston rod 52 of the cylinder 40 is depicted in FIG. 11. This pushes the swivel link 48 outwardly with the swivel link post 53 (see also FIG. 6) trying to move to the end of the slot 54 in the projection 47. However, this is initially ineffective to rotate the member 27 because of the engagement of the pawl 50 within the index cylinder 45. Instead, the swivel link post 53 slides down the slot 54 and pushes against the end 55 of the locking arm 49 to pivot the pawl 50 out of the recess 45*a* of index cylinder 45 — see FIG. 11.

Now that the member 27 is unlocked, the swivel link 48 pushes forward on the projection 47 of the clutch clamp 46 to rotate the member 27 as can be appreciated from FIG. 12. There, the projection is spaced from a stationary stop 56.

In FIG. 13, it is seen that the post 53 of the swivel link 48 has moved past the end of the arm portion 55 and the system is ready for return to "rest". In FIG. 14, the return of the pawl 50 into locking condition is illustrated, this being achieved under the influence of a spring 57 now that there is no constraint on the locking arm 49. This again locks the member 27 and the forward motion of the cylinder 40 stops.

After a short time the controller turns off air pressure to the cylinder 40 and the spring (not shown) in the cylinder pulls back on the swivel link 48. The swivel link 48 slides to the outside of the clamp slot 54 and due to the overrunning clutch 44, the clutch clamp rotates back to the start position. This retraction of the piston rod 52 and the associated movement of the swivel link 48 is illustrated in FIG. 15. Further retraction of the piston rod results in the condition of elements depicted in FIG. 10.

By employing a pawl engaged with the index cylinder 45 and an air cylinder equipped with a spring retracted, the clutch clamp 46 is held in place through the swivel link post 53 and the projection 47 of the clutch clamp 46 is held against the stop 56 so as to keep all components loaded between uses.

SUMMARY

The invention provides a saw blade grinding (honing) system for use on product saws that mainly have a planetary motion (orbit skewed relative to product travel) and wherein the grinder must accurately travel in an orbit matching that of the blade. In this grinding system, unlike past systems, the shafts 32, 33 on which the grinding stones 23, 24 spin (see FIG. 5) are rigidly mounted on a common arm 31. This arm is pivoted by an air cylinder 35 mounted on a housing 26 to bring both the front and rear stones 23, 24 into contact with the blade 21 simultaneously. Even though the stone assemblies are rigidly held to the arm, each of them can be adjusted independently through wedge clamping devices as at 58 and 59 (see FIG. 7).

In order to give the pivoting arm assembly 31 automatic adjustment for blade diameter reduction, the pivot point for the arm is a member 27 (see FIG. 5) equipped with a screw 28 (see FIG. 3). This member/-screw 28 is given a rotary index by an air cylinder 40 at regular intervals as the blade diameter changes, thus moving the grinding stones into a new grinding position automatically.

While in the foregoing specification a detailed description of an embodiment of the invention has been set down for the purpose of illustration, many variations in the details hereingiven may be made by those skilled in the art without departing from the spirit and scope of the claims.

I claim:

1. A method of sharpening a disc blade movable through an orbit skewed with respect to a path in which a product is moved continuously comprising the steps of:

mounting a pair of sharpening stones adjacent the periphery of said disc blade for orbital movement with said disc blade, pivoting said stones simultaneously into contact with the periphery of said disc blade, and incrementally moving said stones toward the disc blade center to compensate for wear, said stones being mounted on an arm extending generally parallel to the plane of said disc blade, said pivoting step including rotating said arm about screw means extending generally radially of said disc blade, said incrementally moving step including selectively coupling said screw means to cylinder means and actuating said cylinder means to turn said screw means.

2. Apparatus for transversely severing multi-ply web material comprising a frame, conveyor means operably associated with said frame for advancing said material therethrough along a generally horizontal path, a planetary arm mounted on said frame adjacent said path, means for rotating said planetary arm about an axis skewed with respect to said path, a sub-frame mounted on said planetary arm spaced from said axis, a disc blade mounted on said sub-frame and arranged to intersect said path, a housing on said sub-frame carrying a rotatable pivot member, an adjustment arm pivotably mounted on said pivot member and extending on opposite sides thereof and carrying a sharpening stone adjacent each end of said adjustment arm, and means operably associated with said adjustment arm and said housing for pivoting said adjustment arm to bring said stones into alignment with the periphery of said disc blade, said member being equipped with vertically extending screw means constituting a pivotal mounting for said adjustment arm thereon, and means for incrementally rotating said screw means to lower said adjustment arm to compensate for disc blade wear, said rotating means including means for locking said screw means in a first position and for releasing said locking means to enable said screw means to assume a second position.

3. The apparatus of claim 2 in which said rotating means includes an L-shaped arm, pawl means on one leg of said L-shaped arm, said rotating means including link means for pivoting said L-shaped arm.

4. Apparatus for transversely severing logs of convolutely wound material comprising a frame, conveyor means operably associated with said frame for advancing logs sequentially therethrough along a generally horizontal path, planetary arm means mounted on said frame above said path, means for rotating said planetary arm means about an axis skewed with respect to said path, housing means equipped with rotatable shaft means mounted on said planetary means spaced from said axis, a disc blade mounted on said shaft means and arranged to intersect said path, a vertically-extending column member mounted in said housing means an adjustment arm pivotally mounted on said column member and carrying a pair of sharpening stones spaced on opposite sides of said column member, and means operably associated with said housing means and said column member for pivoting said adjustment arm to bring said stones into alignment with the periphery of said disc blade, indexing means being interconnected between said housing means and said column member for moving said adjustment arm to compensate for disc blade wear, said column member including a threaded portion along its length intermediate the ends thereof, the upper end of said column member being selectively coupleable to said indexing means.

5. Sharpening apparatus for travel with an orbiting disc blade comprising a housing adapted to be mounted adjacent a disc blade, screw means in said housing, an adjustment arm pivotally mounted about said screw means, said adjustment arm being relatively elongated to provide ends spaced oppositely to said screw means, a grinding stone on each adjustment arm end, first cylinder means coupled between said adjustment arm and said housing to pivot said stones into contact with the periphery of said disc blade, and second cylinder means coupled between said housing and said screw means for incrementally moving said adjustment arm on said screw means to compensate for wear of said disc blade.

6. The apparatus of claim 5 in which said screw means is equipped with clutch means selectively coupled to said second cylinder means.

7. The apparatus of claim 5 in which said adjustment arm is equipped with a generally transversely extending flange, said first cylinder means being mounted on said flange.

* * * * *